US011317750B2

(12) United States Patent
Mailach et al.

(10) Patent No.: US 11,317,750 B2
(45) Date of Patent: May 3, 2022

(54) TRIPARTITE TELESCOPING TENSION ROD ASSEMBLY

(71) Applicant: Umbra LLC, Buffalo, NY (US)

(72) Inventors: Dayna Mailach, Thornhill (CA); Adrienna Matzeg, Toronto (CA)

(73) Assignee: Umbra LLC, Buffalo, NY (US)

( * ) Notice: Subject to any disclaimer, the term of this patent is extended or adjusted under 35 U.S.C. 154(b) by 111 days.

(21) Appl. No.: 16/670,492

(22) Filed: Oct. 31, 2019

(65) Prior Publication Data

US 2021/0127883 A1 May 6, 2021

(51) Int. Cl.

| | |
|---|---|
| ***A47H 1/022*** | (2006.01) |
| ***A47H 1/142*** | (2006.01) |
| *A47H 1/02* | (2006.01) |

(52) U.S. Cl.

CPC ..... *A47H 1/022* (2013.01); *A47H 1/142* (2013.01); *A47H 2001/021* (2013.01)

(58) Field of Classification Search

CPC .. A47H 1/022; A47H 1/142; A47H 2001/021; F16B 7/044; F16B 7/048; Y10T 403/7194; Y10T 403/7182; Y10T 403/7171

See application file for complete search history.

(56) References Cited

U.S. PATENT DOCUMENTS 2,974,805 A * 3/1961 Brossean ..... A47H 1/022 211/105.5
3,035,708 A * 5/1962 Freeman ..... A47B 96/1425 211/107
3,757,705 A * 9/1973 Maslow ..... F16B 12/52 108/147.13
3,771,466 A * 11/1973 Ferdinand ..... A47B 57/42 108/109
4,318,352 A * 3/1982 Friedman ..... A47B 57/265 108/107

(Continued)

OTHER PUBLICATIONS

Amazon.com, Goldcart 3202 Telescopic Garment Rack, Heavy Duty Design, 2017 review by customer, pp. 1-11; https://www.amazon.com/Goldcart-Telescopic-Adjustable-Kilogram-Included/dp/B011KB8P50/ref=sr_1_2?dchild=1&keywords=goldcart+3202+telescopic+garment+rack&qid=1621708737&sr=8-2. (Year: 2017).*

(Continued)

*Primary Examiner* — Kimberly T Wood
(74) *Attorney, Agent, or Firm* — Simpson & Simpson, PLLC

(57) ABSTRACT

A tripartite tension rod assembly, including a first vertical telescoping tension rod, the first tension rod having a first spring loaded endcap and a second non-spring-loaded foot, the first tension rod having a first longitudinal axis; a second vertical telescoping tension rod, the second tension rod having a first spring loaded endcap and a second non-spring-loaded foot, the second tension rod having a second longitudinal axis; a first arcuate bracket arranged to be fixedly secured to the first vertical tension rod; a second arcuate bracket arranged to be fixedly secured to the second vertical tension rod; and, a horizontal telescoping rod extending between the first and second arcuate brackets, the horizontal rod having a third longitudinal axis which, when assembled, is substantially perpendicular to the first and second longitudinal axes.

1 Claim, 7 Drawing Sheets

(56) References Cited

U.S. PATENT DOCUMENTS

| | | | | | |
|---|---|---|---|---|---|
| 5,676,263 | A * | 10/1997 | Chang | A47B 57/26 | 108/147.13 |
| 6,015,052 | A * | 1/2000 | Goldberg | A47B 57/545 | 108/106 |
| 6,068,143 | A * | 5/2000 | Wang | A47B 57/265 | 108/144.11 |
| 6,079,575 | A * | 6/2000 | Wang | A47B 55/02 | 108/110 |
| 6,550,730 | B1 * | 4/2003 | Hong | A47B 96/1425 | 248/219.4 |
| 6,695,156 | B1 * | 2/2004 | Wang | A47B 57/265 | 108/147.11 |
| 7,992,730 | B2 * | 8/2011 | Huang | A47F 5/01 | 211/187 |
| 2002/0113180 | A1 * | 8/2002 | Wiebe | F16M 11/046 | 248/188 |
| 2003/0131767 | A1 * | 7/2003 | Chen | A47B 57/265 | 108/147.13 |

OTHER PUBLICATIONS

Amazon.com, Prince Hanger, Simple 2 Tier Clothes Rack with Curtain, 2015 review by customer, pp. 1-11; https://www.amazon.com/PRINCE-HANGER-Clothing-Organizer-PHUS-0062/dp/BOOBFMUG9M/ref=sr_1_1?dchild=1&keywords=prince+hanger+simple+2+tier&qid=1621709400&sr=8-1 (Year: 2015).*

Amazon.com, Luban King Adjustable clothing rack with 2-Toer Heavy Duty closet Hanger Rod; 2018, pp. 1-12; https://www.amazon.com/Garment-Adjustable-Organizer-Clothes-Storage/dp/B07KM1QHNR/ref=sr_1_2?dchild=1&keywords=luban+king &qid=1621709584&sr=8-2 (Year: 2018).*

Amazon.com, Prince Hanger, Black One-Touch Adjustable 2 Tier Hanger, steel, Heavy Duty, PHUS-0022; customer review 2015; https://www.amazon.com/PRINCE-HANGER-Silver-Adjustable-PHUS-0022/dp/B00C9RF0H0/ref=sr_1_2?dchild=1&keywords=PHUS-0022&qid=1621709912&sr=8-2 (Year: 2015).*

Wayfair; Noelle Room Divider by Beachcrest Home; Available at: https://www.wayfair.ca/furniture/pdp/beachcrest-home-noelle-room-divider-bcmh1929.html; Last Accessed Jul. 9, 2019.

Bed Bath & Beyond; RoomDividersNow Freestanding Room Divider Kit with 9-foot Tall Curtain Panel; Available at: https://www.bedbathandbeyond.com/store/product/roomdividersnow-freestanding-room-divider-kit-with-9-foot-tall-curtain-panel-b/3305890?categoryld=13528; Last Accessed Jul. 9, 2019.

Amazon; Maytex 6099 Twist and Shout Smart Drill Tension 7/8" Window Curtain Drapery Rod; Available at: https://www.amazon.com/Maytex-Window-Hardware-48-84-lnch-Rubbed/dp/B00TV26BXI?creativeASIN=B00TV26BXI&linkCode=w61&imprToken=L4jNDIZSRw98sL5X2B9F6Q&slotNum=3; Last Accessed Jul. 9, 2019.

Amazon; Umbra Coretto 1/2-Inch Drapery Tension Rod; Available at: https://www.amazon.ca/Umbra-Coretto-Drapery-Tension-36-Inch/dp/B00FB6N67C/ref=sr_1_4?keywords=window+tension+rod&qid=1552597005&s=kitchen&sr=1-4; Last Accessed Jul. 9, 2019.

Kwik-hang; Curtain Rod Brackets; Available at: https://kwikhang.com/; Last Accessed Jul. 9, 2019.

Ikea; Schottis Pleated blind, white, 35 1/2x 74 3/4; Available at: https://www.ikea.com/ca/en/p/schottis-pleated-blind-white-20242282/; Last Accessed Jul. 9, 2019.

Jamie's Home Blog; How to Hang Curtains Like MacGyver; Available at: https://jamieshomeblog.com/2013/11/30/how-to-hang-curtains-like-macgyver/; Last Accessed Jul. 9, 2019.

HSN; outdoor curtain rod with post; Available at: https://www.improvementscatalog.com/outdoor-curtain-rod-with-post-set/outdoor-curtains/outdoor-curtain-hardware/280415; Last Accessed Jul. 9, 2019.

Wayfair; Don't Look at Me Privacy Room Divider; Available at: https://www.wayfair.ca/furniture/pdp/symple-stuff-dont-look-at-me-privacy-room-divider-sypl4385 html; Last Accessed Jul. 9, 2019.

* cited by examiner

TRIPARTITE TELESCOPING TENSION ROD ASSEMBLY

FIELD

The present disclosure relates to a tripartite telescoping tension rod assembly to hang drapery and the like.

BACKGROUND

Drapery is often an imperfect solution to incoming and unwanted natural light. Many households, offices, restaurants, stores, and other places have installed various drapery bracket systems, tension rod assemblies, adhesive brackets, nail-in brackets, suction cup brackets, and many other products, and attached drapery to those assemblies to block or redirect this unwanted light. Almost all of these options are damaging solutions. They leave holes in the window frame or wall. They peel the paint off the frame or wall. And those that are not damaging, end up falling to the floor. Simply put, these "solutions" often create more problems than they solve. Essentially, more often than not, a sliver of light still rushes in, permanent holes are made in the drywall, the tension rod eventually falls or causes damage to the structure it is putting stress on, the product is an imperfect fit, or the product is simply not aesthetically pleasing.

It may also be desired to use draperies and curtains internal to a room or space (not proximate a window) for interior design or aesthetic reasons.

It may also be desired that the draperies and/or curtains to be suspended by a horizontal drapery rod are spaced apart from a vertical plane defined by a pair of telescoping vertical tension rods.

Thus, there is a long felt need for a tripartite telescoping tension rod assembly having at least two vertical telescoping tension rods, at least one horizontal telescoping non-tension rod, and arcuate brackets that address and solve these problems.

SUMMARY

The present invention broadly comprises a tripartite telescoping tension rod assembly, comprising a first vertical telescoping tension rod, the first tension rod having a first spring loaded endcap and a second non-spring-loaded foot, the first tension rod having a first longitudinal axis; a second vertical telescoping tension rod, the second tension rod having a first spring loaded endcap and a second non-spring-loaded foot, the second tension rod having a second longitudinal axis; a first arcuate bracket arranged to be fixedly secured to the first vertical tension rod; a second arcuate bracket arranged to be fixedly secured to the second vertical tension rod; and, a horizontal telescoping rod extending between the first and second arcuate brackets, the horizontal rod having a third longitudinal axis, wherein, when assembled, the first and second longitudinal axes are parallel to one another, the third longitudinal axis is substantially perpendicular to the first and second longitudinal axes, the first and second longitudinal axes define a first vertical plane, and the third longitudinal axis is spaced apart from the vertical plane.

A general object of this invention is to provide a tripartite telescoping tension rod assembly, comprising two vertical spaced apart telescoping tension rods, and a horizontal telescoping rod extending between the first and second vertical rods, attached to each with an arcuate bracket, such that the horizontal rod defines a vertical plane which is spaced apart from a vertical plane defined by the two vertical rods, resulting in a more aesthetically pleasing display of the drapes/curtains.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims.

Figure 1:
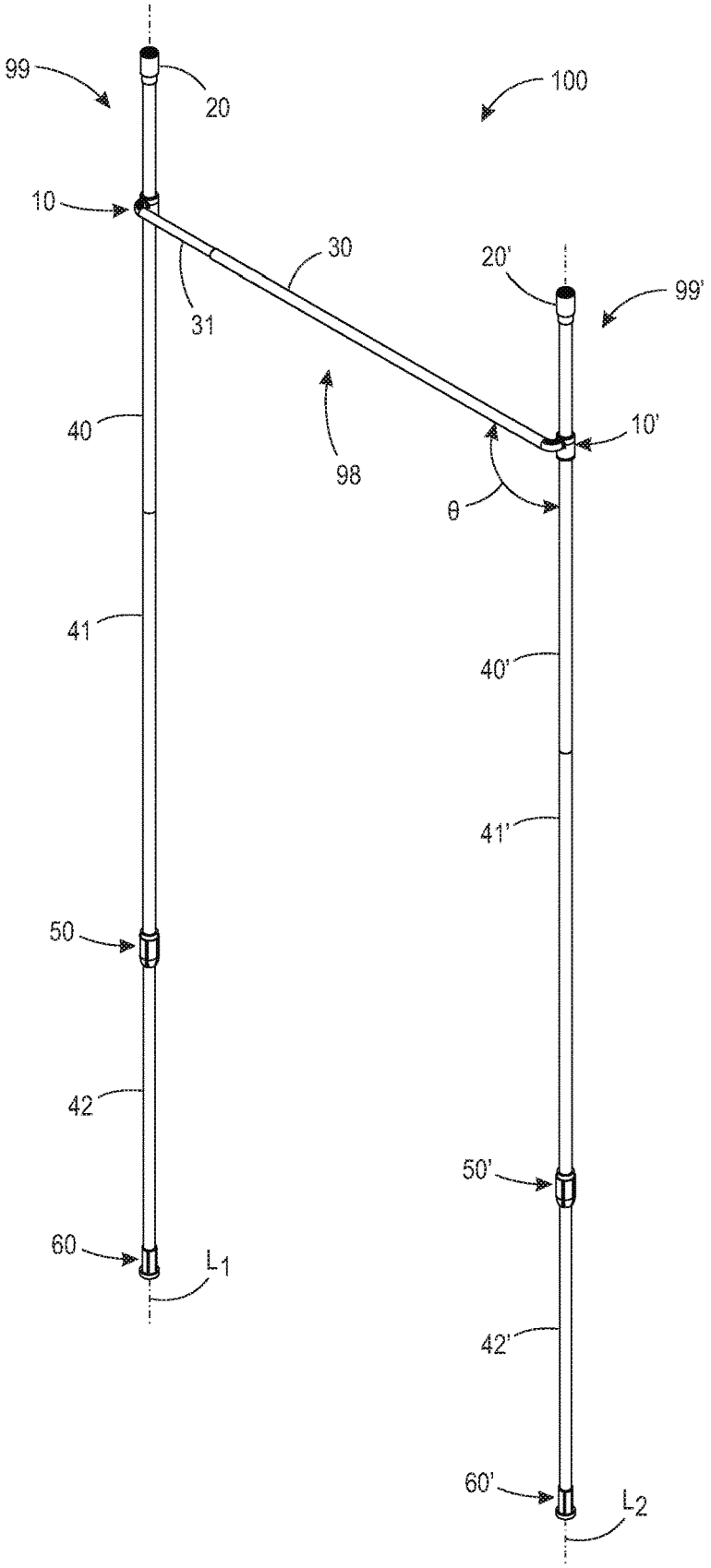
FIG. 1 is a front perspective view of a tripartite telescoping tension rod assembly.

Referring now to the figures, FIG. 1 is a front perspective view of tripartite telescoping tension rod assembly 100. Tripartite telescoping tension rod assembly 100 comprises vertical telescoping tension rods 99 and 99', horizontal telescoping non-tension rod 98. Vertical telescoping tension rod 99 comprises non-spring-loaded foot 60, lower vertical rod 42, height adjuster 50, middle vertical rod 41, upper vertical rod 40, arcuate bracket 10, and spring-loaded endcap 20. Vertical telescoping tension rod 99' comprises non-spring-loaded foot 60', lower vertical rod 42', height adjuster 50', middle vertical rod 41', upper vertical rod 40', arcuate bracket 10', and spring-loaded endcap 20'. Vertical telescoping tension rod 99 has a longitudinal axis L1, and vertical telescoping tension rod 99' has a longitudinal axis L2. Longitudinal axes L1 and L2 are substantially parallel and define vertical plane VP1 (not shown in FIG. 1). Plane VP1 intersects all of the points in axes L1 and L2. Lower vertical rod 42 has a slightly smaller circumference than middle vertical rod 41, this allows lower vertical rod 42 to insert into middle vertical rod 41. Notwithstanding one end of upper vertical rod 40, middle vertical rod 41 and upper vertical rod 40 have the same circumference. One end of upper vertical rod 40 has a slightly smaller circumference compared to the rest of upper vertical rod 40 and middle vertical rod 41 (not shown in FIG. 1). The smaller circumference of upper vertical rod 40 allows it to insert into the top of middle vertical rod 41, wherein the point where upper vertical rod 40's circumference changes rests on the top of middle vertical rod 41. Arcuate bracket 10 can be positioned at any location along vertical rods 40 and 41 by resting it on top of and around clamp 14 (not shown in FIG. 1). Non-spring-loaded foot 60 is threadably secured to the bottom of lower vertical rod 42. Height adjuster 50 is fixedly secured around the point of insertion between lower vertical rod 42 and middle vertical rod 41. Spring-loaded endcap 20 is fixedly secured to the top of upper vertical rod 40. The structure and means by which each component of vertical telescoping tension rod 99' is attached to it are substantially identical to that of vertical telescoping tension rod 99. Horizontal telescoping non-tension rod 98 comprises large horizontal rod 30, and small horizontal rod 31. Small horizontal rod 31 has a slightly smaller circumference than large horizontal rod 30, allowing one end of small horizontal rod 31 to insert into one end of large horizontal rod 30. At the opposite ends of both horizontal rods 30 and 31 is a cap (not shown in FIG. 1). The caps have a hole in them where pegs 15 and 15' (neither shown in FIG. 1) can insert the hole in the respective caps. This will allow horizontal rod 98 to rest in a substantially perpendicular position to that of vertical telescoping tension rods 99 and 99'. This is shown by angle θ, wherein the angle is ninety degrees. Additionally, horizontal non-tension rod 98 has a longitudinal axis L3 (not shown in FIG. 1) which is coincident to vertical plane VP2 (not shown in FIG. 1). Due to arcuate brackets 10 and 10', VP1 and VP2 (neither shown in FIG. 1), while substantially parallel, are spaced apart a distance d (not shown in FIG. 1).

The insertion of lower vertical rod 42 into middle vertical rod 41 allows vertical telescoping tension rod 99 to telescope to different heights. The farther lower vertical rod 42 inserts into middle vertical rod 41, the lesser the height of vertical telescoping tension rod 99. The height adjuster 50 will lock lower vertical rod 42 in the desired position so that the height of vertical telescoping tension rod 99 remains static. Non-spring-loaded foot 60 is generally planar and meant to abut against a floor surface (not shown). Spring-loaded endcap 20 is also generally planar and is meant to abut against a ceiling surface (not shown). The compression spring in spring-loaded endcap 20 creates the tension in vertical telescoping tension rod 99 by pressing outwardly causing non-spring-loaded foot 60 to press against the floor surface, and spring-loaded endcap 20 to press against the ceiling surface. The tension causes vertical telescoping tension rod 99 to remain in a substantially vertical and stable position. The components of vertical telescoping tension rod 99' interact in an identical manner. The insertion of small horizontal rod 31 into large horizontal rod 30 allows horizontal telescoping non-tension rod 98 to be adjusted to different lengths or widths. The telescoping features of the vertical rods and the horizontal rods allow tripartite telescoping tension rod assembly 100 to take on various shapes and sizes. In the embodiment shown in FIG. 1, drapery is meant to be suspended from horizontal telescoping non-tension rod 98. The drapes or curtains can hang in front of a window, or in any desired location. Arcuate brackets 10 and 10', which cause the distance d between VP1 and VP2, allow the drapery to wrap around the edge of a window frame, or any object. This helps the drapery to block the slivers of light that sneak in through the sides of traditional drapes or curtains.

Figure 2:
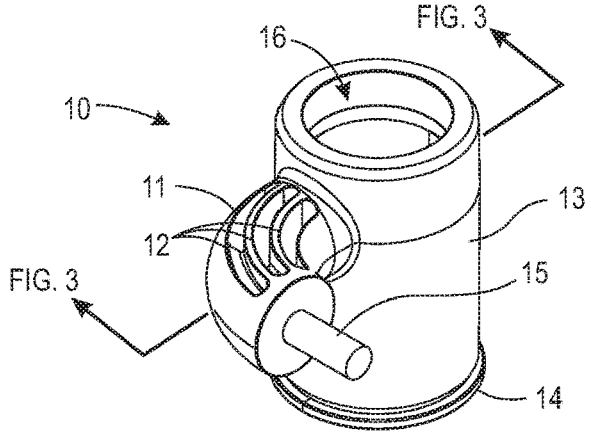
FIG. 2 is a front perspective view of the arcuate bracket of the assembly.

FIG. 2 is a front perspective view of arcuate bracket 10. Arcuate bracket 10 comprises clamp 14, cylindrical base 13, arcuate piece 11, and peg 15. Cylindrical base 13 has a hollow middle 16 so that vertical telescoping tension rod 99 and clamp 14 can fit inside it. Vertical telescoping tension rod 99 inserts hollow middle 16 of cylindrical base 13. Arcuate bracket 10 will then come to rest at the point in which clamp 14 is secured around vertical telescoping tension rod 99. Arcuate piece 11 is fixedly secured to cylindrical base 13. Peg 15 is fixedly secured to the end of arcuate piece 11. Peg 15 will insert into a capped end of horizontal telescoping non-tension rod 98.

Figure 3:
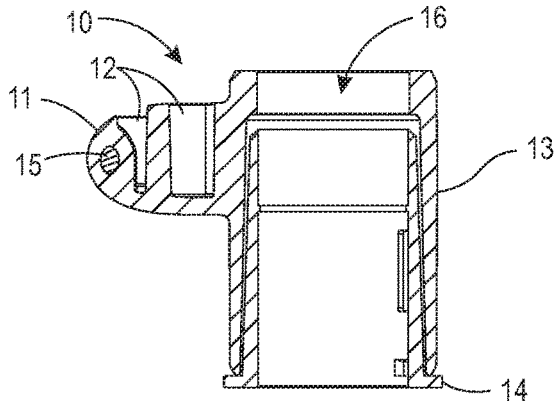
FIG. 3 is a cross-sectional view of the arcuate bracket shown in FIG. 2, taken generally along line FIG. 3—FIG. 3 in FIG. 2.

FIG. 3 is a cross-sectional view of arcuate bracket 10 along line 3-3 shown in FIG. 2. FIG. 3 further illustrates the interaction between cylindrical base 13 and clamp 14. Notably, hollow middle 16 of cylindrical base 13 is not perfectly cylindrical. Hollow middle 16 is tapered wherein the bottom is wider than the top. This allows clamp 14 to fit within cylindrical base 13 when it is secured around vertical telescoping tension rod 99. Cylindrical base 13 will simply rest on clamp 14 by gravitational means.

Figure 4:
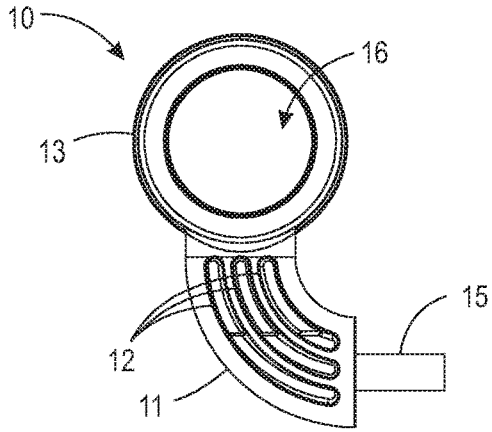
FIG. 4 is a top view of the arcuate bracket shown in FIGS. 2 and 3.

FIG. 4 is a top view of arcuate bracket 10 further illustrating cylindrical base 13, hollow middle 16, the arc of the arcuate piece 11, and peg 15. FIG. 4 more clearly shows the structure of arcuate bracket 10 and how arcuate piece 11 provides the spacing apart of the vertical planes VP1 and VP2 (not shown in FIG. 4).

Figure 5:
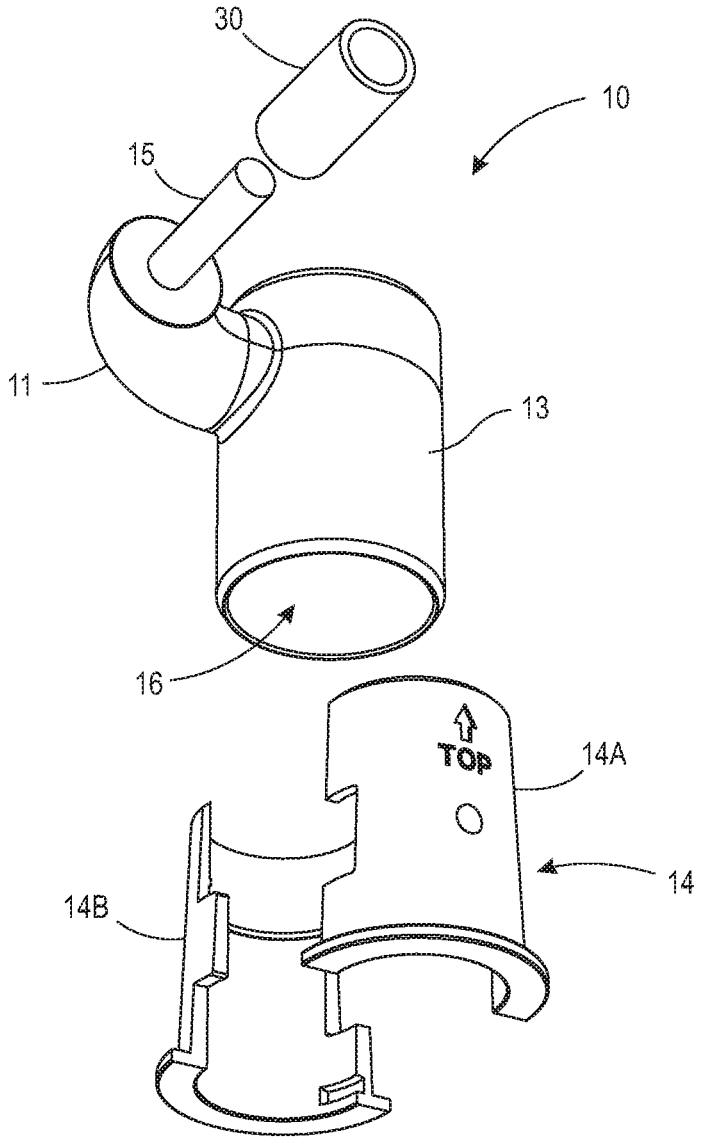
FIG. 5 is an exploded view of the arcuate bracket and bracket clamp of the assembly.

FIG. 5 is an exploded view of arcuate bracket 10 and clamp 14 of the assembly. Clamp 14 comprises clamp 14A and 14B which engage one another and latch around vertical telescoping tension rod 99. When latched, similar to FIGS. 2 and 3, clamp 14 will fit within hollow middle 16. The flat lip at the base of clamp 14 allows cylindrical base 13 to come to rest upon it. Additionally, FIG. 5 helps illustrate the interaction between peg 15 and large horizontal rod 30 (same interaction could take place with small horizontal rod 31) wherein peg 15 inserts into the cap (not shown in FIG. 5) at the end of large horizontal rod 30.

Figure 6:
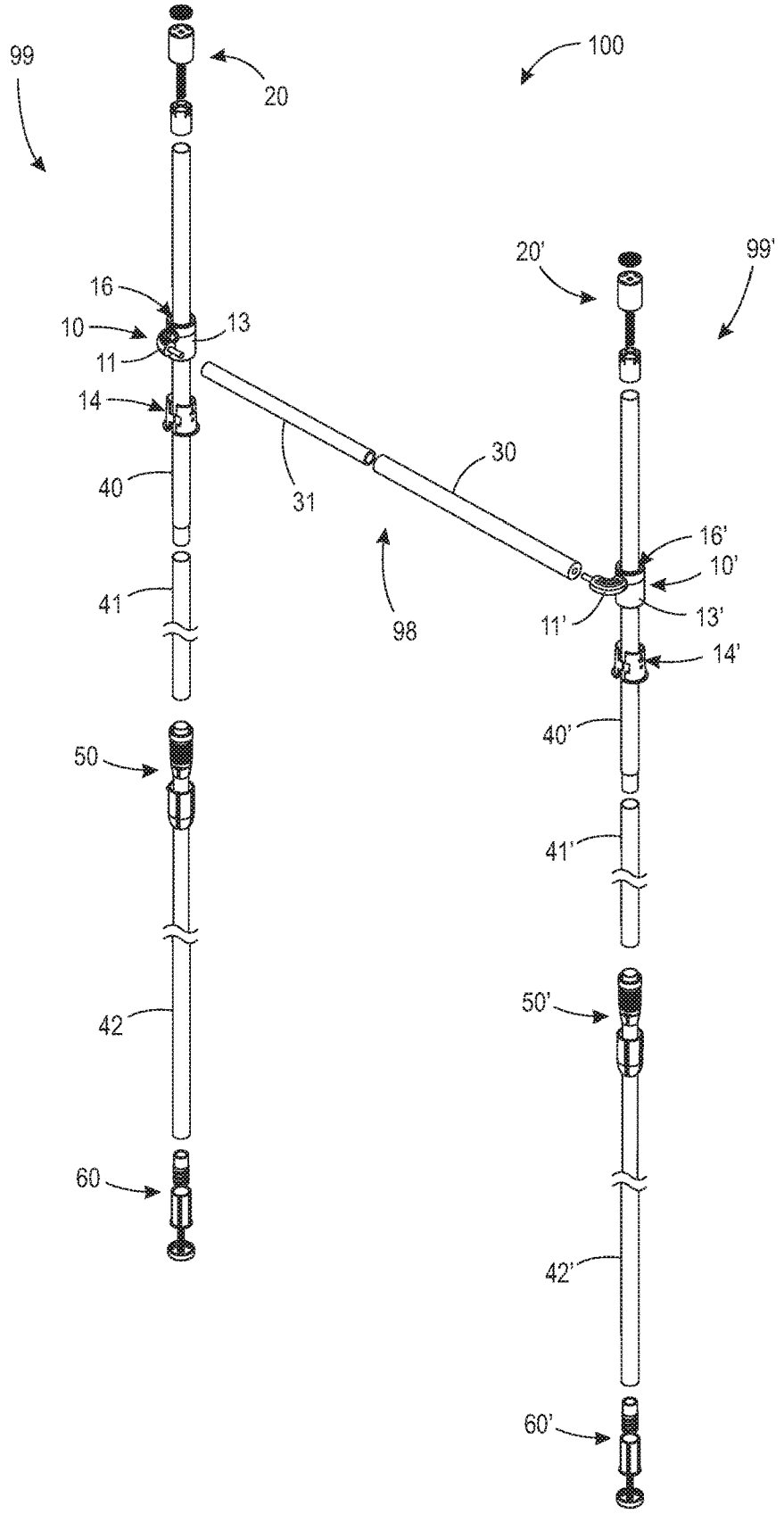
FIG. 6 is a fragmented exploded front perspective view of the tripartite telescoping tension rod assembly in FIG. 1.

FIG. 6 is a fragmented exploded front perspective view of tripartite telescoping tension rod assembly 100. FIG. 6 further illustrates the end of upper vertical rods 40 and 40' that have a smaller circumference than the remainder of upper vertical rod 40 and 40'. It also helps illustrate how clamps 14 and 14' and arcuate brackets 10 and 10' wrap around vertical telescoping tension rods 99 and 99' respectively. FIG. 6 also shows the cap on large horizontal rod 30 where peg 15' (not labeled in FIG. 6) will insert. It should be appreciated that the end of horizontal rod 31 that is not visible will interact with peg 15 (not labeled in FIG. 6) in a substantially identical manner as horizontal rod 30 and peg 15' so that pegs 15 and 15' can insert into either horizontal rod 30 or 31.

Figure 7:
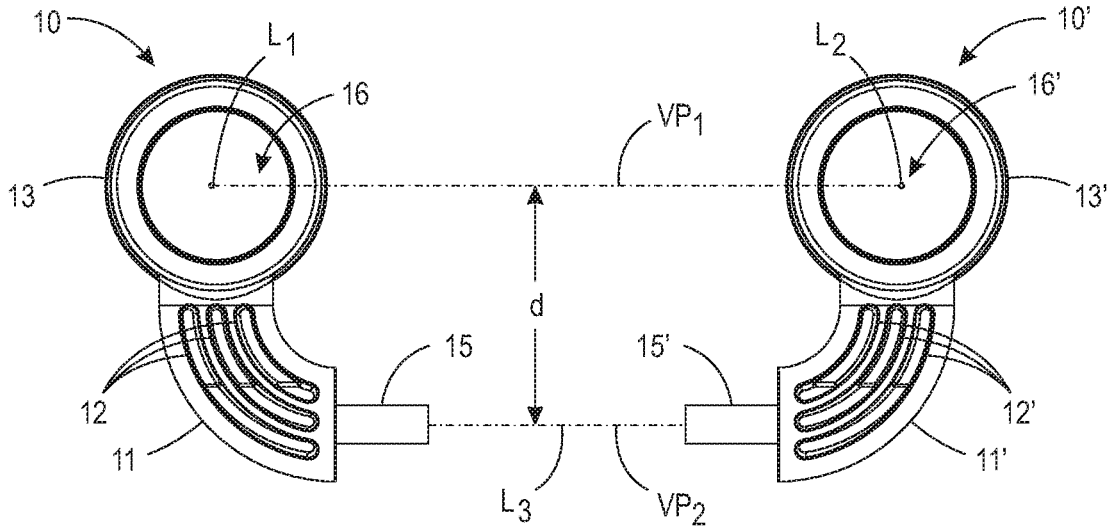
FIG. 7 is a top view of the first and second arcuate brackets 10 and 10' shown in FIGS. 1 and 6.

FIG. 7 is a top view of the first and second arcuate brackets 10 and 10' as shown in FIGS. 1 and 6. FIG. 7 further illustrates the location of longitudinal axes L1, L2, and L3, and vertical planes VP1 and VP2. Vertical telescoping tension rod 99 (not shown in FIG. 7) has a first longitudinal axis L1, vertical telescoping tension rod 99' (not shown in FIG. 7) has a second longitudinal axis L2, and horizontal telescoping non-tension rod 98 (not shown in FIG. 7) has a third longitudinal axis L3 as it extends between arcuate brackets 10 and 10'. Longitudinal axes L1 and L2 are substantially parallel to one another and define a first vertical plane VP1. Longitudinal axis L3 is substantially perpendicular to L1 and L2 and is coincident to a second vertical plane VP2. Vertical planes VP1 and VP2 are substantially parallel to one another, however, due to arcuate brackets 10 and 10', VP2 is spaced apart from VP1 a distance d. This allows anything hung or suspended from horizontal telescoping non-tension rod 98, such as a drape or curtain, to wrap around the edge of whatever it is protecting, such as a window frame. In the example of a drape and window frame, the arcuate brackets 10 and 10' allow the drape to slightly wrap around the edge of the window frame so slivers of light cannot enter the room from the edge of the window frame.

Figure 8:
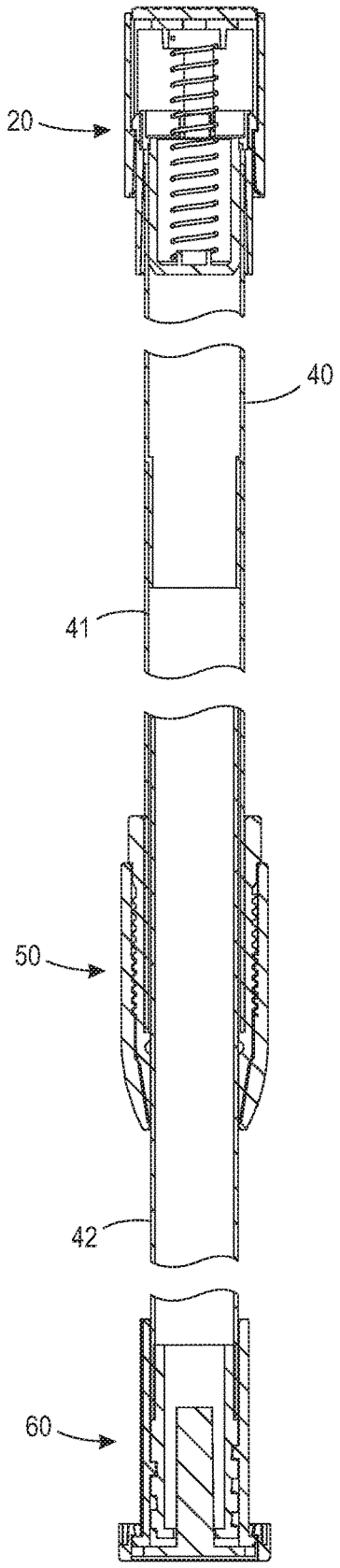
FIG. 8 is a front fragmentary cross-sectional view of one of the vertical telescoping tension rods of the invention, showing a spring-loaded endcap, a height adjuster, and a non-spring-loaded foot; and, FIG. 9 is a front fragmentary cross-sectional view of one of the vertical telescoping tension rods of the invention, showing a spring-loaded endcap, a height adjuster, and a non-spring-loaded foot, similar to that shown in FIG. 8, except with rods 40, 41 and 42 removed (and shown in dotted outline) to show additional internal structure of the assembly.

FIG. 8 is a front fragmentary cross-sectional view of vertical telescoping tension rod 99, spring-loaded endcap 20, height adjuster 50, and non-spring-loaded foot 60. FIG. 8 illustrates the relationship between the different rods of vertical telescoping tension rod 99. Lower vertical rod 42 inserts into middle vertical rod 41. This is shown in the area within height adjuster 50. Additionally, the end of upper vertical rod 40 that has a smaller circumference inserts into the end of middle vertical rod 41. This is illustrated in FIG. 8 as you can see the inserted member of upper vertical rod 40 inside middle vertical rod 41. Additionally, FIG. 8 shows the spring in spring-loaded endcap 20 which causes the tension in vertical telescoping tension rod 99, along with the internal structure of height adjuster 50 and non-spring-loaded foot 60. It should also be appreciated that the structure of vertical telescoping tension rod 99' is substantially identical to that of vertical telescoping tension rod 99.

Figure 9:
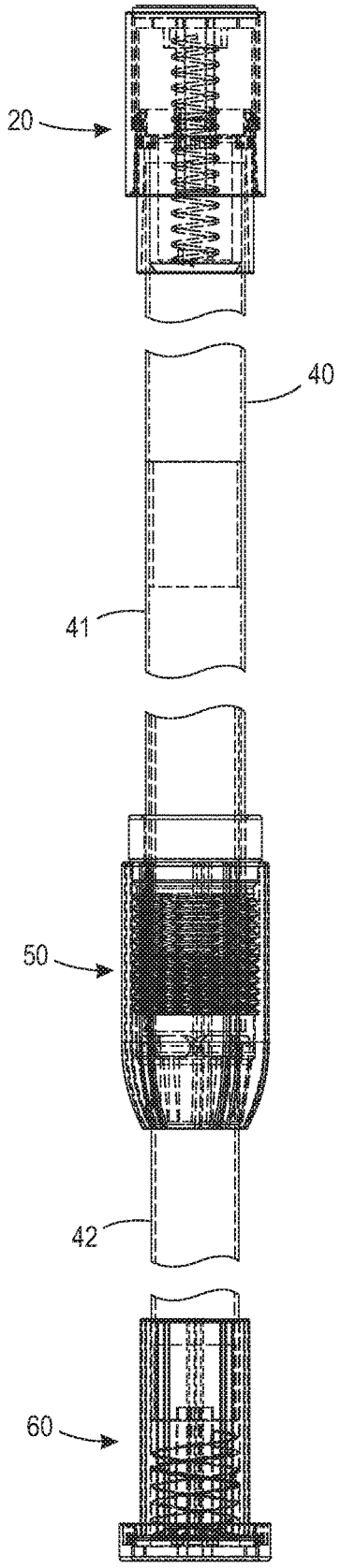

FIG. 9 is a front fragmentary cross-sectional view of vertical telescoping tension rod 99, showing spring-loaded endcap 20, height adjuster 50, and non-spring-loaded foot 60, similar to that shown in FIG. 8, except with rods 40, 41 and 42 removed to show additional internal structure of the assembly.

It should be appreciated that the embodiment as shown is only one of a variety of possible embodiments of the claimed invention. For example, another embodiment could have three vertical telescoping tension rods and two horizontal telescoping non-tension rods, as well as four arcuate brackets and not just two.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

REFERENCE NUMERALS

10 Arcuate bracket
10' Arcuate bracket
11 Arcuate piece
11' Arcuate piece
13 Cylindrical base
13' Cylindrical base
14 Clamp
14' Clamp
14A Clamp
14B Clamp
15 Peg
15' Peg
16 Hollow middle
16' Hollow middle
20 Spring-loaded endcap
20' Spring-loaded endcap
30 Large horizontal rod
31 Small horizontal rod
40 Upper vertical rod
40' Upper vertical rod
41 Middle vertical rod
41' Middle vertical rod
42 Lower vertical rod
42' Lower vertical rod
50 Height adjuster
50' Height adjuster
60 Non-spring-loaded foot
60' Non-spring-loaded foot
98 Horizontal telescoping tension rod
99 Vertical telescoping tension rod
99' Vertical telescoping tension rod
100 Tripartite telescoping tension rod assembly
L1 Longitudinal axis
L2 Longitudinal axis
L3 Longitudinal axis
VP1 Vertical plane
VP2 Vertical plane
θ Angle of 90°

What is claimed is:

1. A tripartite telescoping tension rod assembly, comprising:

a first telescoping vertical tension rod, said first telescoping vertical tension rod having a spring-loaded endcap and a non-spring-loaded foot, said first telescoping vertical tension rod arranged about a first longitudinal axis;

a second telescoping vertical tension rod, said second telescoping vertical tension rod having a spring-loaded endcap and a non-spring-loaded foot, said second telescoping vertical tension rod arranged about a second longitudinal axis;

a first two-piece clamp arranged to frictionally secure to said first telescoping vertical tension rod, said first two-piece clamp arranged to removably accept a first arcuate bracket thereon, said first arcuate bracket having an arc extending therefrom, said arc arranged perpendicularly to said first telescoping vertical tension rod, said arc having a peg extending therefrom;

a second two-piece clamp arranged to frictionally secure to said second telescoping vertical tension rod, said second two-piece clamp arranged to removably accept a second arcuate bracket thereon, said second arcuate bracket having an arc extending therefrom, said arc arranged perpendicularly to said second telescoping vertical tension rod, said arc having a peg extending therefrom; and, a horizontal telescoping rod extending between said first and second arcuate brackets, said horizontal telescoping rod arranged to engage said peg of said first arcuate bracket at a first end and to engage said peg of said second arcuate bracket at a second end, said horizontal rod arranged about a third longitudinal axis wherein, when assembled, said first and second longitudinal axes are parallel to one another, said third longitudinal axis is substantially perpendicular to said first and second longitudinal axes, said first and second longitudinal axes define a first vertical plane, and said third longitudinal axis is coincident with a second vertical plane spaced apart from and parallel to said first vertical plane.

* * * * *